US010582279B2

(12) United States Patent
Yang et al.

(10) Patent No.: US 10,582,279 B2
(45) Date of Patent: Mar. 3, 2020

(54) LOUDSPEAKER MODULE

(71) Applicant: GOERTEK INC., WeiFang (CN)

(72) Inventors: Yun Yang, WeiFang (CN); Dan Han, WeiFang (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 15/572,142

(22) PCT Filed: Nov. 18, 2015

(86) PCT No.: PCT/CN2015/094899

§ 371 (c)(1),
(2) Date: Nov. 6, 2017

(87) PCT Pub. No.: WO2016/179997

PCT Pub. Date: Nov. 17, 2016

(65) Prior Publication Data

US 2018/0132018 A1 May 10, 2018

(30) Foreign Application Priority Data

May 12, 2015 (CN) ..... 2015 1 0240603

(51) Int. Cl.
*H04R 1/02* (2006.01)
*H04R 1/06* (2006.01)
(Continued)

(52) U.S. Cl.
CPC ..... *H04R 1/02* (2013.01); *H04R 1/06* (2013.01); *H04R 3/00* (2013.01); *H04R 1/2811* (2013.01);
(Continued)

(58) Field of Classification Search
CPC . H04R 1/08; H04R 9/08; H04R 11/04; H04R 17/02; H04R 21/02; H04R 1/02; H04R 1/105; H04R 1/025; H04R 1/026
(Continued)

(56) References Cited

U.S. PATENT DOCUMENTS 6,473,511 B1 * 10/2002 Aceti ..... A61B 5/6817 381/322
8,385,569 B2 * 2/2013 Hachinohe ..... B81B 7/0061 381/189
(Continued)

FOREIGN PATENT DOCUMENTS

CN 201234343 Y 5/2009
CN 201699774 U 1/2011
(Continued)

OTHER PUBLICATIONS

Office Action from Chinese Patent Office for Application No. 201510240603.3 dated Dec. 5, 2017.
International Search Report for PCT/CN2015/094899 filed on Nov. 18, 2015.

*Primary Examiner* — Suhan Ni

(57) ABSTRACT

Disclosed is a loudspeaker module, comprising a module housing and a single loudspeaker; a module inner cavity configured to receive the single loudspeaker is formed in the module housing; and the module housing comprises a module upper housing and a module lower housing, the module upper housing is arranged at the outer side of a front cover of the single loudspeaker, the module upper housing is provided with a metal sheet in an injection molding manner, and a grounding terminal configured to be in grounding connection with an application terminal of the loudspeaker module is led out from the metal sheet. The loudspeaker module of the present invention not only is aiding in thinning, but also can ensure the matching stability between a loudspeaker and an application terminal.

7 Claims, 2 Drawing Sheets

(51) Int. Cl.

| | |
|---|---|
| ***H04R 3/00*** | (2006.01) |
| *H04R 1/28* | (2006.01) |
| *H04R 9/06* | (2006.01) |
| *H04R 31/00* | (2006.01) |

(52) U.S. Cl.
CPC ..... *H04R 9/06* (2013.01); *H04R 31/006* (2013.01); *H04R 2201/029* (2013.01); *H04R 2400/11* (2013.01); *H04R 2499/11* (2013.01)

(58) Field of Classification Search
USPC ..... 381/365, 369, 178, 374, 384, 386, 394
See application file for complete search history.

(56) References Cited

U.S. PATENT DOCUMENTS 8,891,806 B2 * 11/2014 Jun ..... H01R 12/721 379/433.02
8,913,756 B2 * 12/2014 Chang ..... H01R 13/46 361/733
9,020,177 B2 * 4/2015 Cohen ..... H04R 1/2857 381/333
2001/0043709 A1 * 11/2001 Panitzsch ..... H01M 2/1066 381/330

FOREIGN PATENT DOCUMENTS

| | | | |
|---|---|---|---|
| CN | 103269462 | A | 8/2013 |
| CN | 103531905 | A | 1/2014 |
| CN | 203446021 | U | 2/2014 |
| CN | 204046808 | U | 12/2014 |
| CN | 104540076 | A | 4/2015 |
| CN | 104811835 | A | 7/2015 |
| CN | 204681532 | U | 9/2015 |
| JP | 2011-239086 | A | 11/2011 |

* cited by examiner

LOUDSPEAKER MODULE

CROSS-REFERENCE TO RELATED APPLICATIONS

The present specification is a U.S. National Stage of International Patent Application No. PCT/CN2015/094899, filed Nov. 18, 2015, which claims priority to and the benefit of Chinese Patent Application No. 201510240603.3, filed May 12, 2015, the entire contents of which are incorporated herein by reference.

TECHNICAL FIELD

The present invention relates to the technical field of electro-acoustic products, and more particularly, to a loudspeaker module.

BACKGROUND ART

The loudspeaker module is an important acoustical component of the portable electronic device, is used for transforming electrical signal and acoustical signal, and is an energy converter. The module housing of the loudspeaker module generally comprises an upper module housing and a lower module housing, which jointly enclose a module inner cavity for accommodating the loudspeaker unit.

The existing loudspeaker module generally comprises a module housing and a loudspeaker unit, and the module housing forms a module inner cavity for accommodating the loudspeaker unit. The module inner cavity is divided into a front acoustic cavity and a rear acoustic cavity by the loudspeaker unit. The module housing comprises an upper module housing and a lower module housing, and the loudspeaker unit is typically mounted at a position adjacent to the upper module housing. In order to increase the space of the vibration area of the vibration system of the loudspeaker unit, the mainstream solution of the existing micro loudspeaker is to replace the plastic housing above the vibration area with an injection-molded steel sheet structure on the plastic housing. The housing with such a structure allows to reduce the thickness of the housing in the case of satisfying the requirements on the strength of the housing, which relatively increases the volume of the inner cavity of the housing, thereby effectively expanding the vibration space of the vibration system. However, when the housing is provided with a steel sheet in an injection molding manner, the metal structure of the steel sheet will affect the application terminal of the loudspeaker, so that the matching between the application terminal of the loudspeaker and the loudspeaker is affected and is poor in stability, thereby decreasing the stability of the application terminal of the loudspeaker, and affecting the quality of the application terminal of the loudspeaker.

SUMMARY

The technical problem sought to be solved by the present invention is to provide a loudspeaker module which is favorable for thinning of the loudspeaker module, and can ensure the matching stability between the loudspeaker and the application terminal.

In order to solve the above technical problem, the technical solution of the present invention is:

a loudspeaker module, comprising a module housing and a loudspeaker unit, wherein an inner cavity of the loudspeaker module for accommodating the loudspeaker unit is formed in the module housing, the module housing comprises an upper module housing and a lower module housing, the upper module housing is arranged at the outer side of a front cover of the loudspeaker unit, and the upper module housing is coupled with a metal sheet through injection molding, wherein a grounding terminal configured to be in grounding connection with an application terminal of the loudspeaker module is led out from the metal sheet.

Preferably, the grounding terminal is fixed on the upper module housing and is exposed to the outside of the upper module housing.

Preferably, the grounding terminal is electrically connected to the metal sheet through an electric connecting piece.

Preferably, the metal sheet, the electric connecting piece and the grounding terminal are coupled to the upper module housing through injection molding, and the grounding terminal is exposed to the outside.

Preferably, the metal sheet, the electric connecting piece and the grounding terminal are formed as an integral structure.

Preferably, the metal sheet is a steel sheet.

According to the technical solutions of the present invention, the advantageous effects of the present invention are described below.

In the loudspeaker module of the present invention, the upper module housing is coupled with a metal sheet through injection molding, and a grounding terminal configured to be in grounding connection with an application terminal of the loudspeaker module is led out from the metal sheet. When the loudspeaker module with this structure is mounted to the application terminal, it is possible to effectively suppress or eliminate the interference of the metal structure of the metal sheet to the application terminal, to ensure the matching stability between the loudspeaker module and the application terminal, thereby ensuring the quality of the application terminal of the loudspeaker module.

In the present invention, the grounding terminal is provided on the upper module housing, and is relatively firm, thereby facilitating the grounding connection of the grounding terminal of the metal sheet with the application terminal of the loudspeaker module.

Figure 1:
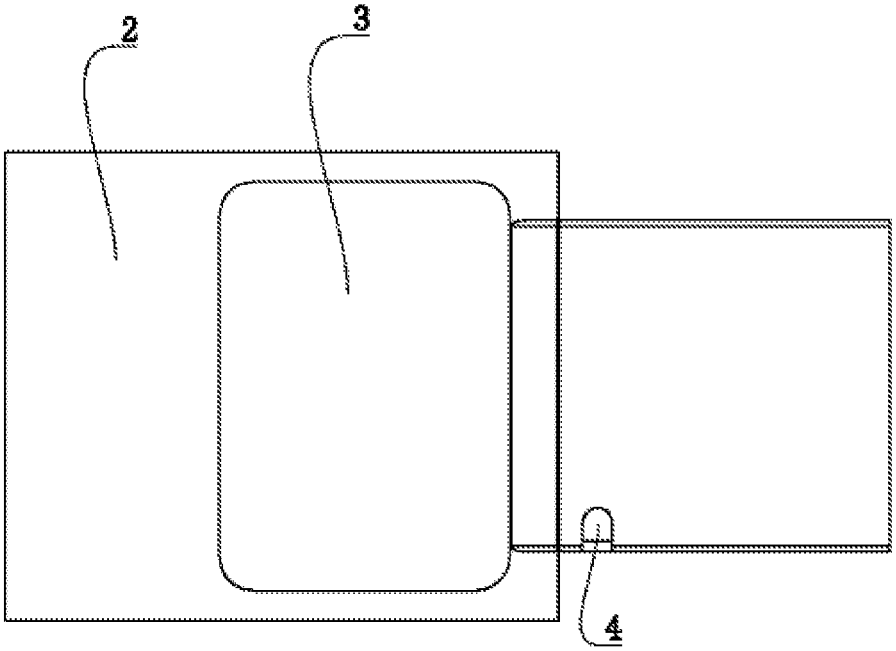
FIG. 1 is a schematic structural view of the top of the loudspeaker module of the present invention.

In the drawings: 1, loudspeaker unit; 2, upper module housing; 3, steel sheet; 4, grounding terminal; 5, electric connecting piece; 6, lower module housing.

DETAILED DESCRIPTION OF EMBODIMENTS

Hereinafter, the present invention is further described in detail with regard to accompanying drawings and embodiments in order to make the objectives, technical solutions and advantages of the present invention more clear. It will be understood that the discussed particular embodiments are only used for explaining the present invention, but not for limiting the present invention.

Figure 2:
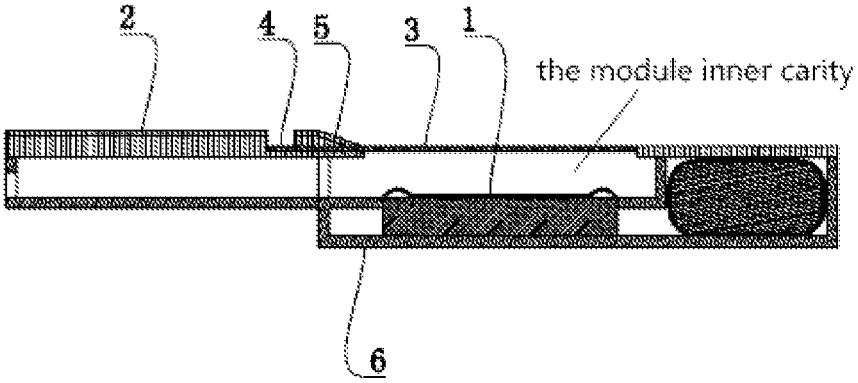
FIG. 2 is a schematic structural view of a cross section in FIG. 1.
Figure 3:
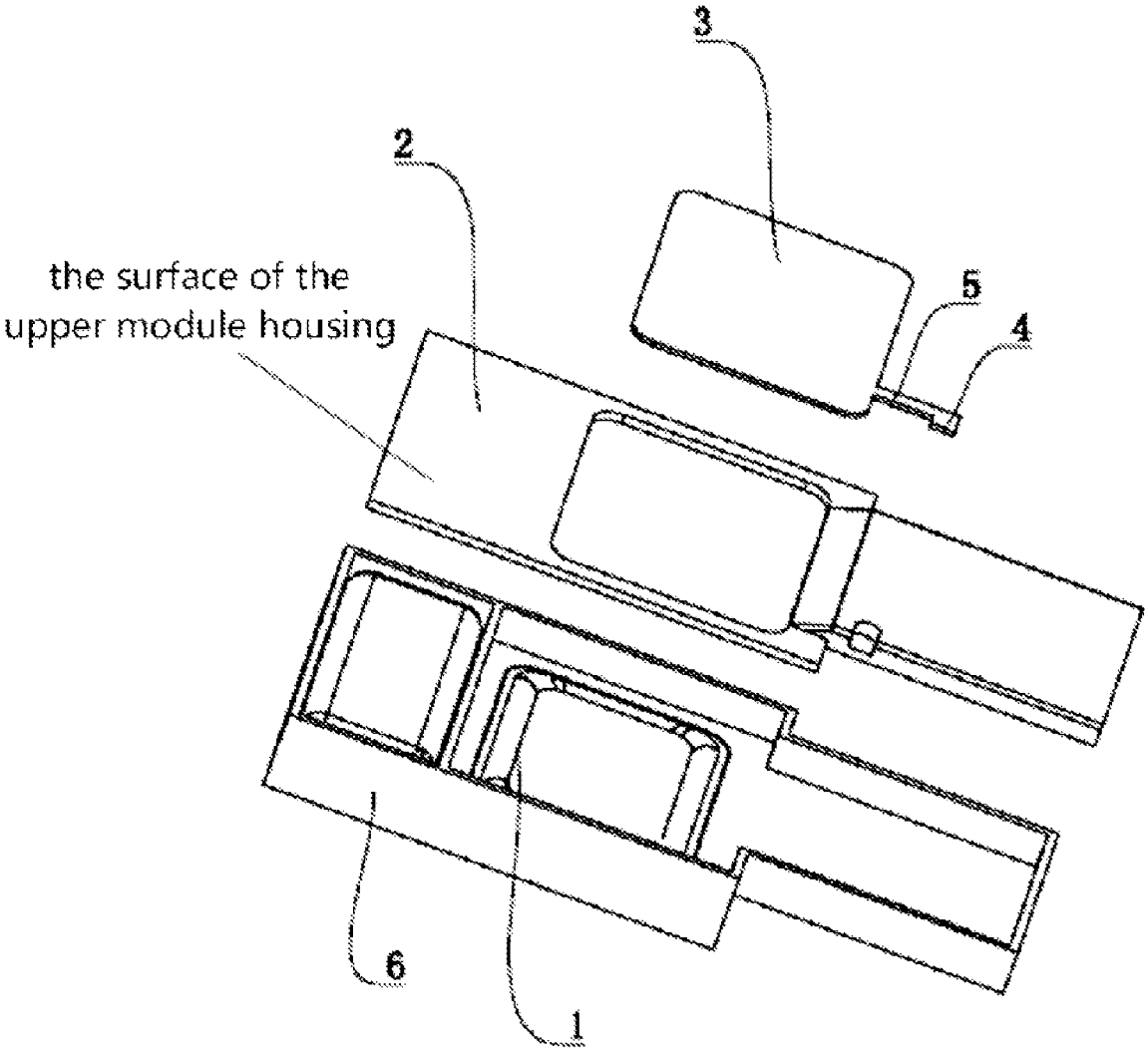
FIG. 3 is an exploded schematic structural view of FIG. 1.

Referring to FIGS. 1, 2 and 3, a loudspeaker module comprises a module housing and a loudspeaker unit 1. A module inner cavity for accommodating the loudspeaker unit 1 is formed in the module housing; and the module housing comprises an upper module housing 2 and a lower module housing 6. The upper module housing 2 is arranged at the outer side of a front cover of the loudspeaker unit 1, and the upper module housing 2 is coupled with a metal sheet through injection molding. In the present embodiment, the metal sheet is a steel sheet 3. A grounding terminal 4 configured to be in grounding connection with an application terminal of the loudspeaker module is led out from the steel sheet 3.

The grounding terminal of the steel sheet 3 is fixed to the upper module housing 2 and is exposed to the outside of the upper module housing 2, which is relatively firm, thereby facilitating the grounding connection of the grounding terminal 4 of the steel sheet 3 with the application terminal of the loudspeaker module. The grounding terminal of the steel sheet 3 may employ a spot-welded structure, a screw-fixed structure, a riveted structure, a structure in which an elastic piece is used for connection in a contact way, a structure in which a conductive adhesive is used, and other fixedly connected structures to be connected to the ground of the application terminal of the loudspeaker module.

In the present embodiment, the grounding terminal 4 is electrically connected to the steel sheet 3 through the electric connecting piece 5. The steel sheet 3, the electric connecting piece 5 and the grounding terminal 4 are coupled to the upper module housing 2 through injection molding, and the grounding terminal 4 is exposed to the outside so as to facilitate the connection of the grounding terminal 4 of the steel sheet 3 to the application terminal when the loudspeaker module is mounted on the application terminal. The steel sheet 3, the electric connecting piece 5, and the grounding terminal 4 are formed as an integral structure, but are not limited to the integral structure.

In the loudspeaker module of the present embodiment, the upper module housing 2 is coupled with a steel sheet 3 through injection molding, and a grounding terminal 4 configured to be in grounding connection with an application terminal of the loudspeaker module is led out from the steel sheet 3. When the loudspeaker module with this structure is mounted to the application terminal, it is possible to effectively suppress or eliminate the interference of the metal structure of the steel sheet 3 to the application terminal, to ensure the matching stability between the loudspeaker module and the application terminal, thereby ensuring the quality of the application terminal of the loudspeaker module.

The foregoing is an example of a preferred embodiment of the present invention in which those not described in detail are well known to those skilled in the art. The scope of protection of the present invention is subject to the contents of the claims, and any equivalent transformation based on the technical enlightenment of the present invention also falls into the scope of protection of the present invention.

The invention claimed is:

1. A loudspeaker module, comprising:

a module housing and a loudspeaker unit, wherein an inner cavity of the loudspeaker module for accommodating the loudspeaker unit is formed in the module housing, the module housing comprises an upper module housing and a lower module housing, the upper module housing is arranged at an outer side of a front cover of the loudspeaker unit, and the upper module housing is coupled with a metal sheet through injection molding, wherein a grounding terminal configured to be in grounding connection with an application terminal of the loudspeaker module is led out from the metal sheet, wherein the metal sheet is provided to increase a relative volume of the inner cavity of an acoustic chamber, wherein the grounding terminal suppresses interference of a metal structure of the metal sheet to the application terminal, and the ground terminal is formed from the same sheet of metal as the metal sheet, wherein the grounding terminal is electrically connected to the metal sheet through an electric connecting piece, wherein the metal sheet, the electric connecting piece and the grounding terminal are coupled to the upper module housing through injection molding, and the grounding terminal is exposed to the outside.

2. The loudspeaker module according to claim 1, wherein the metal sheet, the electric connecting piece and the grounding terminal are formed as an integral structure.

3. The loudspeaker module according to claim 1, wherein the metal sheet is a steel sheet.

4. The loudspeaker module according to claim 1, wherein the entire metal sheet is flat.

5. The loudspeaker module according to claim 1, wherein the metal sheet is a surface of the upper module housing.

6. The loudspeaker module according to claim 1, wherein the ground terminal is a tab that extends outward from the metal sheet.

7. The loudspeaker module according to claim 6, wherein the sheet of metal further comprises an electric connecting piece that connects the ground terminal tab to the metal sheet.

* * * * *